US009226091B2

(12) United States Patent
Lyons et al.

(10) Patent No.: US 9,226,091 B2
(45) Date of Patent: Dec. 29, 2015

(54) ACOUSTIC SURROUND IMMERSION CONTROL SYSTEM AND METHOD

(71) Applicant: Polk Audio, Inc., Baltimore, MD (US)

(72) Inventors: Matthew Lyons, York, PA (US); Gabriel F. Slotnick, Baltimore, MD (US)

( * ) Notice: Subject to any disclaimer, the term of this patent is extended or adjusted under 35 U.S.C. 154(b) by 0 days.

(21) Appl. No.: 14/031,032

(22) Filed: Sep. 18, 2013

(65) Prior Publication Data

US 2015/0341738 A1 Nov. 26, 2015

Related U.S. Application Data

(60) Provisional application No. 61/702,728, filed on Sep. 18, 2012.

(51) Int. Cl.

| | |
|---|---|
| ***H04R 5/02*** | (2006.01) |
| ***H04S 7/00*** | (2006.01) |
| ***H04R 5/04*** | (2006.01) |

(52) U.S. Cl.

CPC .. *H04S 7/40* (2013.01); *H04R 5/02* (2013.01); *H04R 5/04* (2013.01); *H04R 2499/15* (2013.01); *H04S 2420/01* (2013.01)

(58) Field of Classification Search

CPC ..... H04S 7/40; H04S 2420/01; H04R 5/04; H04R 5/02; H04R 2499/15

USPC ..... 381/306, 303, 77

See application file for complete search history.

(56) References Cited

U.S. PATENT DOCUMENTS 6,490,359 B1 * 12/2002 Gibson ..... G10H 1/0008 381/119

* cited by examiner

*Primary Examiner* — Paul S Kim

(74) *Attorney, Agent, or Firm* — KC Bean, Esq.

(57) ABSTRACT

A method and speaker system that provides a single, user adjustable tool for controlling how and which spatialization parameters are used in a single speaker multi-driver system to enhance the sound stage. The tool creates the desired amount of audio surround effect to enhance the sound stage experience or effects in multiple sound recording mode, such as music or movies. The tool is represented in a scale that runs from '−10' (less immersive) to '+10' (more immersive) is set to taste by the listener and will vary with room acoustics and placement.

10 Claims, 5 Drawing Sheets

| SSA Immersion (OSD) | SRS (In1) | Direct (In2) | Sum | Front SDA | Center Dynamic Trim |
|---|---|---|---|---|---|
| -10 | -30 | 0 | 0.00 | 0 | 0 |
| -9 | -20 | -0.1 | -0.06 | -0.1 | 0 |
| -8 | -14 | -0.2 | -0.02 | -0.2 | 0 |
| -7 | -8.5 | -0.7 | -0.03 | -0.7 | 0 |
| -6 | -7 | -1 | -0.03 | -1 | 0 |
| -5 | -5 | -1.3 | -0.03 | -1.3 | 0 |
| -4 | -6 | -1.7 | -0.03 | -1.7 | 0 |
| -3 | -5 | -2.3 | -0.06 | -2.3 | 0 |
| -2 | -4 | -2.5 | -0.05 | -2.5 | 0 |
| -1 | -3.7 | -2.9 | -0.04 | -2.9 | 0 |
| 0 | -3 | -3 | -0.01 | -3 | 0 |
| 1 | -2.9 | -3.2 | -0.04 | -3.2 | 0 |
| 2 | -2.5 | -3.7 | -0.05 | -3.7 | 0 |
| 3 | -2.3 | -4 | -0.06 | -4 | 0 |
| 4 | -1.7 | -5 | -0.03 | -5 | 0 |
| 5 | -1.3 | -6 | -0.03 | -6 | -0.5 |
| 6 | -1 | -7 | -0.03 | -7 | -1 |
| 7 | -0.7 | -8.5 | -0.03 | -8.5 | -1.5 |
| 8 | -0.2 | -14 | -0.02 | -14 | -2 |
| 9 | -0.1 | -20 | -0.06 | -20 | -2.5 |
| 10 | 0 | -30 | 0.00 | -30 | -3 |
| | | | | | |
| | | | | | |
| | | | | | |
| | Mixer2×1_1_VOL0, Mixer2×1_1_VOL0 | Mixer2×1_1_VOL1, Mixer2×1_1_VOL1 | | Shared Volume _2_VOL | Volume_9 _VOL |

FIG. 5

ACOUSTIC SURROUND IMMERSION CONTROL SYSTEM AND METHOD

CROSS-REFERENCE TO RELATED APPLICATIONS

This application claims the benefit of and is a continuation of U.S. Provisional Patent Application Ser. No. 61/702,728 filed Sep. 18, 2013

BACKGROUND OF THE INVENTION

The present invention is in the technical field of digitally and acoustically controlled audio signal processing systems and methods. More particularly, the present invention is in the technical field of signal processing of acoustic signals to allow for a full sound stage imaging experience by acoustic and electronic manipulation using digital signal processing and applied psychoacoustic principles.

Conventional speaker system designs use various techniques to provide for an authentic listening experience of sound recordings. Movie Theater and live music performances provide listener perceived acoustic images and spatial characteristics. These characteristics are desirable in audio recordings and movie sound tracks when intended for later playback. A number of factors impact the listening experience of recorded sound. The placement of speakers within the listening environment, the reflection of sound off of objects in the environment, the power output to speaker driver components when playing particular individual notes or frequencies, volume of play, harmonics and frequency cancellation and other psychoacoustic phenomena all affect the fidelity of the acoustic sound image, spatial perception and overall sound quality. Audio engineers have uses a variety of well-known techniques to address limitations in sound reproduction resulting from a particular speaker design, from environmental factors where speakers are used, and from biological processes in the ear and brain hearing process.

Traditionally, large home speakers with separate drivers for hi, mid, and low frequencies were used primarily for music listening. These speakers were generally large and required calculated placement in a dedicated listening space. Over time, consumers began using these systems for in-home movie viewing. With the advancement of digital technology, more and more sophisticated digital video and digital sound systems have become available and home theater systems are now ubiquitous. Consumers expect their home theater systems to authentically recreate the sound experience of traditional theaters and 5.1 and 7.1 speaker systems. Consumers now demand the same listening experience for both music and movie viewing in small inconspicuous speaker enclosure. Multi-driver, single speaker systems, known as surround bars, have been developed to satisfy this demand.

Interaural Crosstalk

The brain uses the small difference in arrival time of a sound to each ear to calculate the direction or origin of the sound. For example, if a sound arrives at your right ear before arriving at your left ear, the listener perceives the sound as coming from somewhere to the right. This phenomenon is known as interaural time difference (ITD). Our brain measures and processes those subtle timing differences in a way that allows us to accurately determine where a sound source is located Interaural crosstalk (IAC) occurs when two sound sources (for example a set of speakers) which are separated in space and are intended to replace a single source. In such an arrangement, you get a sound signal representative of a single sound arriving at each ear from the left speaker and a sound signal arriving at each ear from the right speaker, each with a slight time delay. This is unnatural and one of the flaws of stereo reproduction of recorded sound. It is also IAC that restricts the sound stage for the playback of recorded sound from stereo speakers to the area between the speakers, reducing the sound stage and distorting the sound image. IAC is a fundamental problem not only for stereo surround sound reproduction but for any system with more than one speaker. It is because of IAC that we hear the positions of the speakers in a stereo system and not the natural surround sound or live sound stage experience. The effect of IAC when listening to recorded sound is to tell your brain where the speakers are located while, at the same time, covering up the original recorded sound source location information. Once your brain knows where the loudspeakers are all of the sounds seem to come only from the loudspeaker locations and the space in between the speakers, reducing the perceived sound stage and your sense of immersion with the performance. This is nothing like what you would hear at the original concert or in a real world environment, and it is one of the major reasons why even the best conventional playback systems still don't quite sound like the real thing.

Methods of cancellation of IAC to created a very wide soundstage are known. One method provides pairing a driver located about one head width outside a second driver unit that reproduces the normal Left and Right front channel signals. The additional drivers receive an inverted version of the sound signal from the opposite channel. The geometry and spacing of the drive units insures that this inverted crosstalk cancellation signal arrives at the ear at the same time as the unwanted IAC and acoustically cancels it. The geometry also insures that proper cancellation will occur regardless of how far apart the two speakers are or how far away the listener sits. The head-width based geometry of the system means that the system functions properly regardless of how far apart the left and right rear channel drivers are located or how far away you are sitting.

Another method used to cancel IAC is through the use of digital signal processing in multi-driver speaker systems. Sound emitted from each driver in the system is manipulated in time, volume or frequency shift relative to a second or third driver or channel within the system. In this way selective sound waves can be cancelled or enhance and the timing of signals can be modified to create perceptual impression of location in the sound stage. These cancellation and image stabilizing signals are limited to a range of psychoacoustically significant frequencies, mainly in the midrange. The use of a carefully determined frequency range for these signals contributes to the natural sound and highly musical characteristic of the speaker sound, meaning the system delivers a credible surround sound experience over a much broader range of listening locations.

Each of these signals, including the main left and right rear channel signals, is modified by its own front-to-back transformation filter. For each of the rear signals, a separate front-to-back filter transforms the rear signals such that when they are combined acoustically at the listener's ears the resulting perceived sounds have characteristics associated with a sound originating from behind you rather than in front. The benefit of eliminating (or at least substantially reducing) IAC is that you now hear the original recorded information relating to the locations of the instruments and the acoustics of the concert hall unrestricted by the locations of your playback speakers.

Head Related Transfer Functions

If there is a time delay for sound arriving at your left ear relative to your right ear the sound is perceived as coming from a location to the right of center. The greater the time delay, the further to the right sound is perceived. The smaller the time delay, the closer to the center. Zero time delay means the sound is perceived as originating directly in front of you or directly behind you. This perceived directionality also occurs for sounds located directly to either side of the head. In our example, a time delay would be the same for a sound originating off center from right or left side of the head, either to the front or to the rear.

To address the ambiguity, the asymmetry of our ears, head, and torso changes the frequency response of sound arriving from behind us so that they sound different than if they were in front. This is also, generally, how we determine whether a sound is above us or below us. In fact, for each possible direction of arrival at our ear there is a unique frequency response characteristic or sonic signature based on the shape features of the head. So long as we are somewhat familiar with the sound, such as the voice of someone we know or a door slamming, we can easily and accurately determine high or low, front or back, which direction it's coming from. U.S. Pat. No. 8,000,485, which is fully incorporated herein by reference, describes a number of the mathematical equations applicable to calculating the perceived location of sound.

It is possible using well know digital signal processing techniques to electronically manipulate or synthesize the correct HRTF adjusted sound signal that provides perceptual cues to make a sound coming from a loudspeaker directly in front of you seem like it's coming from behind you. The achievement of "virtual" surround sound is accomplished by feeding the surround channels to a pair of front speakers with the correct electronic and digital signal HRTF reformatting, so that they sound like they're behind you rather than in front. A number of devices have used digital signal processing to electronically synthesize the proper audio signals that provide HRTF cues to make two front loudspeakers seem as though they are reproducing the sound of five loudspeakers surrounding the listener. Many digital audio systems include "virtual" surround algorithms to simulate a surround sound experience.

To function properly all of these systems require speakers with high enough performance capability to preserve the accuracy of the synthesized or digitally enhanced HRTF adjusted signals. It is also required that the speakers and listener be located in exactly the positions that correspond to the synthesized HRTF cues. The HRTF cues are also somewhat different for each person, and those differences can mean that a system that produces a convincing surround sound illusion for one person may barely work for another. To avoid these limitations, it is preferable to use the HRTF cues that rely only on those key features of the HRTF's that are common to everyone and have nearly identical sound characteristics over a broad range of sound arrival directions. Many of these key HRTF cue components lie within the same range of frequencies found to be psychoacoustically important for the cancellation of IAC. Sound signal filters containing the key HRTF cue components are combined with crosstalk cancellation signals, binaural image stabilization signals and time delays to achieve both cancellation of IAC and front to back soundstage transformation. This system works much more sympathetically with the way that we hear naturally and offers a more natural surround sound experience over a broader range of seating locations than purely electronic attempts to synthesize a virtual 5.1 system. Additionally, of course, the system works for almost anyone with normal hearing.

Using these techniques provides tremendous flexibility in speaker placement and listener location options and works equally well for almost anyone with normal hearing. In addition, HRTF recognizes that movement of the listener is an important part of the surround sound experience. The HRTF acoustic cues that reach the listeners ears while the listener moves dynamically reinforce the surround sound experience as the listener turns or moves their head.

Audio engineers have used various acoustical engineering techniques, digital signal processing and applied psychoacoustic sound signal manipulation in speakers to develop sophisticated and authentic sound stages with accurate spatial and acoustic image reproduction of movie theater experience or live music performance experience. However, in known single speaker surround bar audio applications these methods are independent, mutually exclusive and dedicated to a single speaker design application. For example, if a speaker is intended for home theater movie viewing, one set of digital signal processing techniques and applied psychoacoustic configurations are applied, and if a music listening application is intended a different set of configurations are used. The optimal configuration for movie viewing is different from the optimal configuration for music listening. A configuration intended for a movie can create distortions and reduced fidelity if applied to music listening. To reconfigure an audio surround bar system that has been configured for movie viewing to one intended for music listening requires sophisticated technical understanding and expertise. Reconfiguration requires changes in many of the DSP, and other configuration parameters. Reconfiguration becomes even more challenging when using a single speaker surround bar system. The average listener will simply not make the changes in configuration when changing between movies and music modes, enduring a limited sound experience.

Therefore, a need exists for a simple audio configuration control that allows for ready change between movie viewing configuration and music listening configuration of a surround bar type speaker audio system.

SUMMARY OF THE INVENTION

The present invention is a speaker system capable of, and a method for, processing acoustic signals for playback in a single speaker multi-drive surround sound system to allow for full sound stage imaging and a realistic reproduction of spatial acoustic experience of the listener when listening to the playback of recorded music or when listening to digital movie sound tracks. The sub parameters controlled by the method include Head Related Transfer Functions (HRTFs), Inter Aural Crosstalk (IAC) Cancellation, Direct/unprocessed signal, and center channel level. The method provides for full immersion of the listener in the available sound stage created by the speaker system regardless of whether the system is used for music listening or home theater. One advantage of the current invention is that it provides a single user adjustable tool that controls how and which spatialization sub parameter configurations are used to create the desired amount of surround effect in the sound stage.

The tool is represented as an on-screen display sound stage audio immersion scale (SSA Immersion Scale). The user accesses the scale using a remote controller and the system on-screen display. The SSA Immersion Scale is presented to the user via the on-screen display when the user enters the configuration mode. The user adjusts the configurations of the various sub parameters using a single scale that runs from '−10' (less immersive) to '+10' (more immersive). The SSA Immersion Scale setting is set by the listener and adjusted for listener taste and listening environment. The amount of processing required to achieve the desired immersion effect varies greatly depending on room acoustics and speaker placement.

In an alternative embodiment, the sound immersion scale is embodied in a smart phone application. Current smart phones incorporate a Bluetooth® wireless function that allows for short range pairing and radio frequency communications of electronic devices. In the smart phone embodiment of the current invention, an application is downloaded to the phone. The application essentially allows the user to replace the television's remote control with the smart phone to control the functionality of the speaker system. The speaker includes a Bluetooth® or other short range radio frequency capability and is paired to the smartphone.

Additionally, the smartphone can serve as the display device for digitally recorded movies or as the digital audio player for music, with both digital movies and music downloaded from the internet. Preferably, headphones are used with the smart phone; the audio signal provided to the headphones from the smart phone either wirelessly or through an audio cable. As the movie or music is played, the phone app performs the function of configuring the sub parameters to provide maximum sound stage immersion.

The SSA Immersion scale adjusts each sub parameter by use of an algorithm. The SSA Immersion Scale is correlated to each sub parameter and concurrently shifts emphasis on each sub parameter to a configuration that is preferable for either music listening or movie sound track listening, favors the most useful tool to maximize the sound immersion experience and adjusting the others to work well in tandem.

BRIEF DESCRIPTION OF THE DRAWING

FIG. 5 is a table representative of one embodiment of the weighting of various signal components of immersion scale of the current invention.

DETAILED DESCRIPTION OF THE INVENTION

Figure 1:
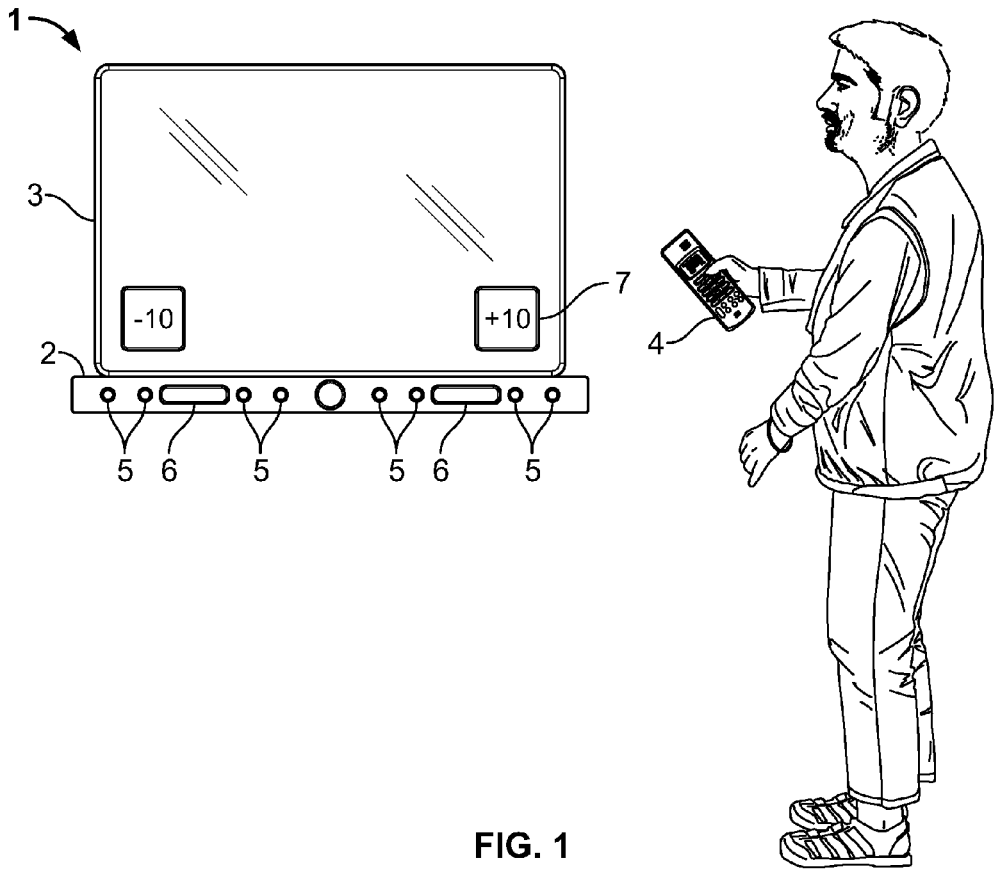
FIG. 1 is a schematic representation of one embodiment of the speaker system of the current invention.

Referring now to FIG. 1, the figure shown is a schematic representation of the inventive speaker system 1. The system 1 includes a single enclosure, multi-driver speaker 2, a television display 3 and a remote control unit 4. The speaker 2 contains a plurality of drivers that include both high frequency drivers 5 and mid range drivers 6. The television 3 includes an on screen display that presents the sound immersion tool 7, which is accessed through an on screen display menu (not shown)_and navigated using the remote control 4. The sound immersion tool 7 is represented as a sliding scale. It will be recognized by those skilled in the art that any representation scheme can be used. Within the speaker 2, but not shown, are various well known electronic subsystems that power the drivers and provide a means to transfer the audio signal from the source to the drivers. Also within the speaker is a module for digital signal processing.

Figure 2:
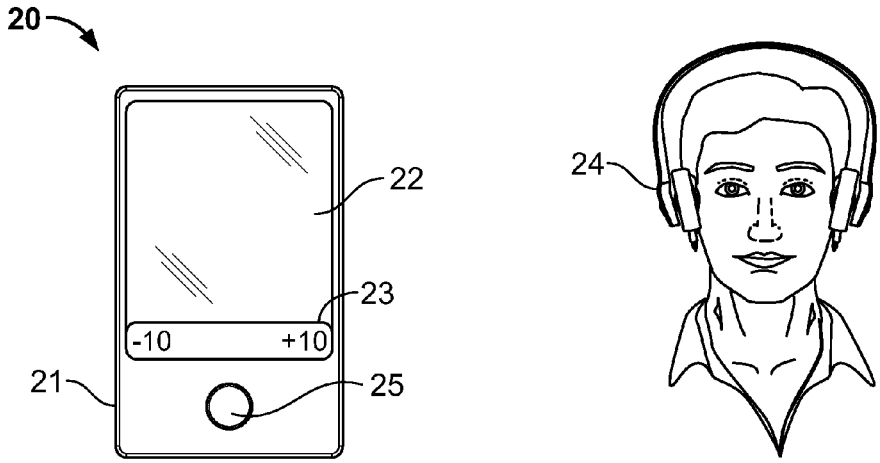
FIG. 2 is a schematic representation of a second embodiment of the current inventive speaker system.

FIG. 2 demonstrates an alternative embodiment of the system 20 whereby a smart phone 21 is comprised of a display 22 for viewing the representation of the tool 23. The smart phone 21 is further comprised of an internal processor and memory (both not shown) for storing programming data and instructions associated with the tool 23 along with other functions of the smart phone. An audio signal is provided to headphones 24 worn by the listener. The audio signal can be transferred to the headphones 24 from the smart phone 21 through a wired or wireless means. The user can select the configuration of the tool 23 through an app or through manipulation of the smart phone buttons 25, keys or other input devices.

Figure 3:
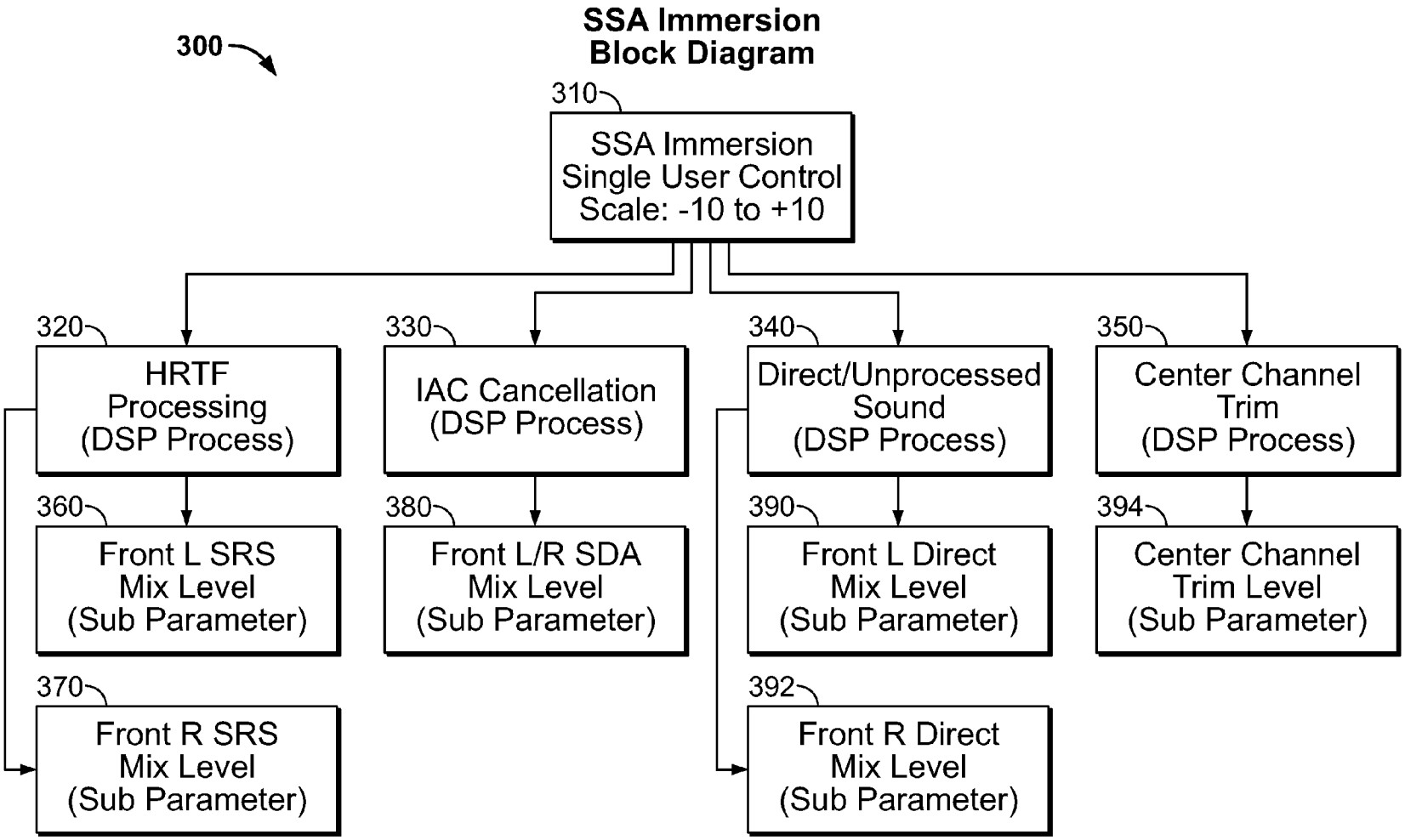
FIG. 3 is a block diagram showing various processing inputs associated with the current invention.
Figure 4:
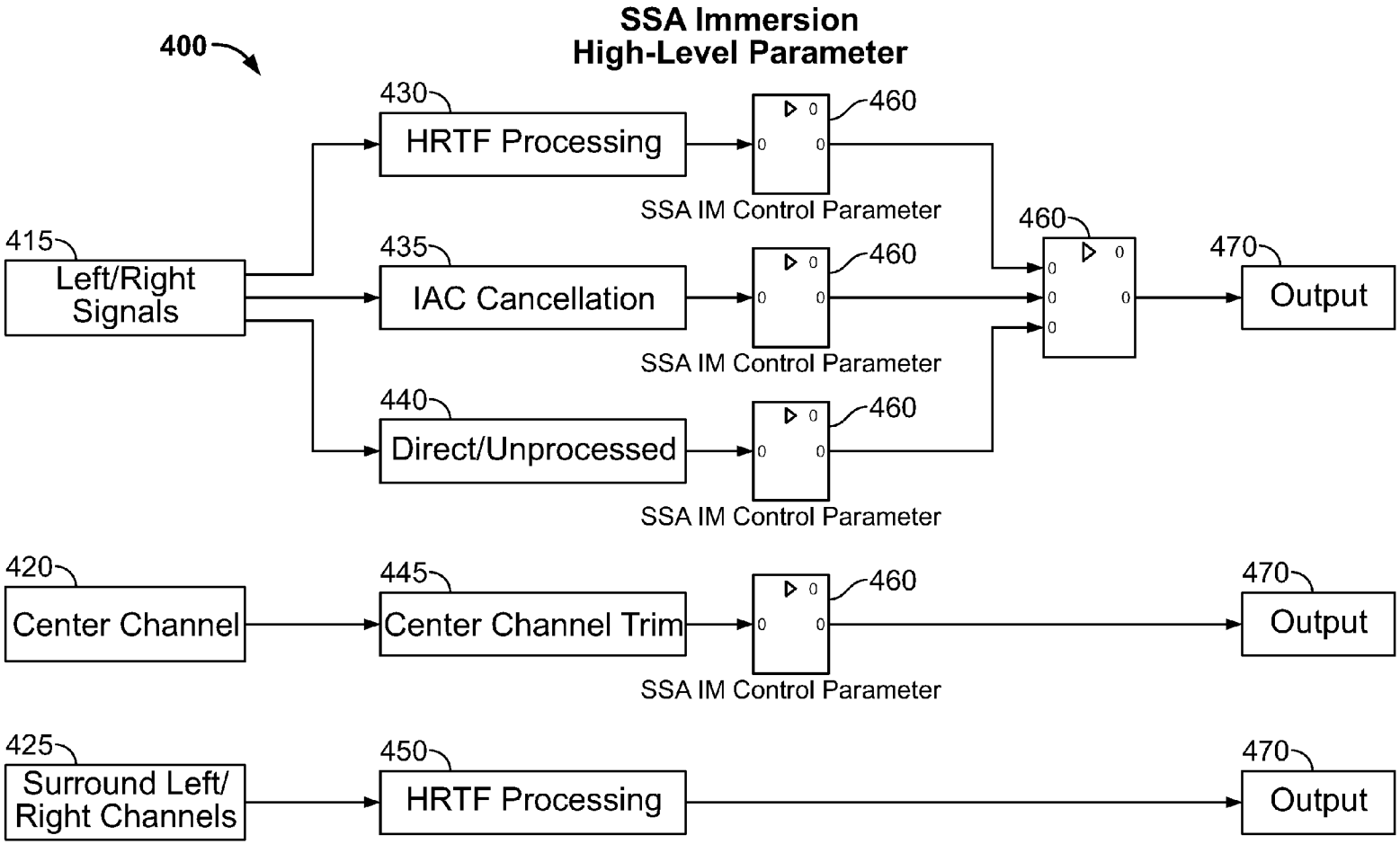
FIG. 4 is a block diagram showing the high level parameters used in processing signals of the present invention.

The method of the current invention are described in more detail in FIGS. 3 and 4, the method 300 is represented as a block diagrams, showing the various sub parameter components and the soundstage audio immersion processing unit. The SSA Immersion Scale is controlled using a processing module 310 includes a processing algorithm that correlates the SSA Immersion Scale to the configuration settings of the head related transfer function module 320, the interaural crosstalk module 330, the direct signal module 340, and the center level control module 350. Each of the modules receives a digital signal from the audio source. Each module has a separate digital signal processing function or algorithm that individually maximizes the sound immersion of the specified module. If the source is music or surround sound source, each module processes the source sound signal in a manner that is consistent with the codex for music or surround sound respectively.

The head related transfer function processing module 320, the interaural crosstalk cancellation module 330, and the direct sound channel 340 each processes signals to the front left 7 and front right 8 drivers. The sound source signal to the center channel trim 350 is process to adjust the trim level 394.

FIG. 4 presents high level representation of the signal processing steps for the SSA Immersion. An audio source (not shown) provides a digital signal for the left/right channel 415, the center channel 420, or the surround left/right channels 425. The signal is modified in the HRTF processing module 430, the IAC processing module 435, the direct signal processing module 440 by filtering, amplifying, frequency cancelling, volume adjustment or digital signal processing techniques to provide HRTF, IAC cancellation and channel sound signal changes that impact perception cues of the listener. The resulting signals from each channel are correlated to the SSA Immersion Scale 460 and output 470 to speaker drivers.

It will be appreciated by one of ordinary skilled in the art that a number of know digital signal processing methods and algorithms are suitable at the signal processing steps. For example, DTS, SRS Labs, Dolby and others have developed well known digital signal processing methods and algorithms that are suitable.

FIG. 5 is a table demonstrating one possible weighting of the signal processing values of the various signal components with their associated output values. For example, if the user selects the signal immersion associated with music at −10 the SRS, Direct, Front and center channel trim all have associated output values −30, 0, 0 and 0 respectively. As the user adjust the immersion scale represented as an on screen display each component is adjusted accordingly pre the preset weighting of the table.

Figure 6:
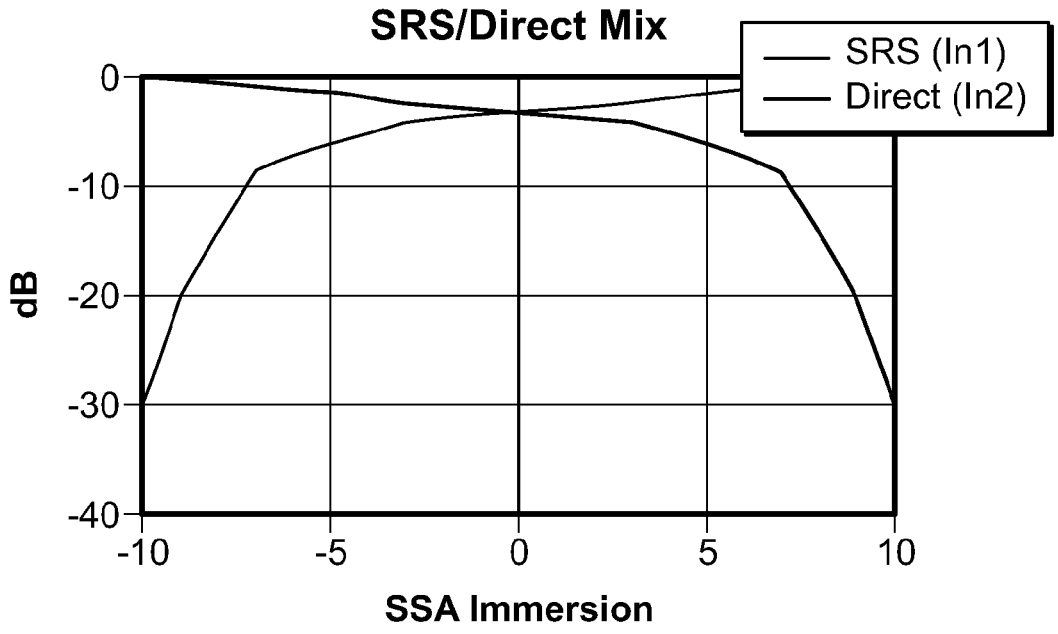
FIG. 6 is a graphical representation of the inverse correlation between processed SRS music audio signal, and the direct unprocessed signal of movies.

FIG. 6 is a graphical representation of the inverse correlation between processed SRS signal music audio, and the Direct unprocessed signal of movies. As the listener adjust the immersion scale to the −10 value the SRS signal becomes less prominent component of the output signal and the Direct signal becomes the more prominent component of the output signal. As the user adjust the immersion scale to the +10, the opposite occurs and each respective signal components become inverse to its prior output.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

We claim:

1. An audio speaker system comprising:

a speaker having a housing and a plurality of speaker drivers; wherein said speaker drivers are operably associated with an audio signal source and capable of generating audio sound at a plurality of audio frequencies corresponding to a right channel, left channel, center channel and rear channels of an audio signal;

a digital signal processor electrically associated with the speaker drivers and audio signal source, said processor receiving the audio signal from the audio signal source and modifying said audio signal such that the resulting audio signal include changes in the timing of signal transmission, volume level or frequency of the right channel, left channel, center channel or rear channel signals such that the generated audio sound provides psychoacoustic cues corresponding to acoustical characteristics that reproduce the original spatial acoustic experience;

a display associated with said speaker drivers and processor; wherein said display provides an on screen image representation of the acoustical characteristics and wherein such acoustical characteristics may be modified.

2. The audio speaker system of claim 1 further comprising a remote controller, the remote controller is in wireless communication with the system and provides remote access to the on screen image of the display and whereby modification are made to the plurality of acoustical characteristics.

3. The audio speaker system of claim 1, wherein the speaker housing is a single speaker enclosure.

4. The audio speaker system of claim 1, wherein the speaker housing is a pair of headphones.

5. The audio speaker system of claim 1, wherein the psychoacoustic cues are selected from head related transfer function cues, interaural crosstalk cancellation, or audio volume level.

6. The audio speaker system of claim 1, wherein the display is a television or a smart phone display.

7. A method for changing the acoustical output characteristics of an audio speaker system comprising the steps of:

programming into a memory a plurality of sets of predetermined parameters corresponding to audio signal digital processing and acoustic outputs that generate psychoacoustic cues, said outputs and cues associated with acoustical soundstage characteristics;

graphically representing the set of parameters on a display;

selecting one of said sets of parameter by selecting the corresponding graphical representation of said set of parameters;

receiving an audio signal having at least a right channel, left channel and center channel signal;

processing said audio signal and generating an acoustic output according to the selected set of predetermined parameters.

8. The method claim 7 wherein the set of parameter on a display is graphically represented as a sliding scale.

9. The method of claim 7 wherein the acoustical soundstage characteristics are selected from a group including music or movies.

10. The method of claim 7 wherein the display is a television or smart phone display.

* * * * *